US011105199B2

(12) United States Patent
Locotos et al.

(10) Patent No.: US 11,105,199 B2
(45) Date of Patent: Aug. 31, 2021

(54) SYSTEM AND METHOD FOR SUPPORTING SIDEWALLS OR RIBS IN COAL MINES

(71) Applicant: Square Cut Systems, LLC, Pittsburgh, PA (US)

(72) Inventors: Frank M. Locotos, Bridgeville, PA (US); David J. Nardo, Belmont, OH (US)

(73) Assignee: Square Cut Systems, LLC, Pittsburgh, PA (US)

( * ) Notice: Subject to any disclaimer, the term of this patent is extended or adjusted under 35 U.S.C. 154(b) by 0 days.

(21) Appl. No.: 17/016,445

(22) Filed: Sep. 10, 2020

(65) Prior Publication Data

US 2021/0071526 A1 Mar. 11, 2021

Related U.S. Application Data

(60) Provisional application No. 62/898,580, filed on Sep. 11, 2019.

(51) Int. Cl.
*E21D 21/00* (2006.01)

(52) U.S. Cl.
CPC ..... *E21D 21/0086* (2013.01); *E21D 21/0006* (2013.01); *E21D 21/0026* (2013.01)

(58) Field of Classification Search
CPC ..... E21D 21/0086; E21D 21/0006; E21D 21/0026
See application file for complete search history.

(56) References Cited

U.S. PATENT DOCUMENTS 2,685,221 A * 8/1954 Lee ..... E21D 21/008 411/55
3,238,731 A * 3/1966 Seifert ..... E21D 21/0086 405/302.1
3,478,523 A * 11/1969 Morse ..... E21D 21/0086 405/302.1
4,023,225 A * 5/1977 Tochilkin ..... B21J 3/00 470/11

(Continued)

OTHER PUBLICATIONS

Minova, GFRP Products, webpages, http://www.minovaglobal.com/americas/our-products/steel-and-gfrp-products/gfrp-products/, Oct. 2020, US.

(Continued)

*Primary Examiner* — Benjamin F Fiorello
(74) *Attorney, Agent, or Firm* — McKay Law

(57) ABSTRACT

A cuttable, sinkable mining bolt system for use in supporting the sidewall or rib in a coal mine. A bearing plate has a plurality of hollow cores defined transaxially therein and a central hole defined axially therethrough, the bearing plate made of modified recycled, rigid PVC compound. A fiberglass bolt is adapted to be inserted through the central hole of bearing plate. Bolt is one-piece consisting of glass fiber reinforced plastic. Head component includes a square head and integral, beveled washer for self-centering in the bearing plate as rod component is driven into rib. Bearing plates are adapted to sink into a refuse stream. Hollow cores of bearing plate reduce the material and thus the weight and expense of the bearing plate while still allowing the bearing plates to sink. Optionally, rod components can be inserted transaxially through the hollow cores to increase the strength and coverage of the system.

10 Claims, 8 Drawing Sheets

(56) References Cited

U.S. PATENT DOCUMENTS 4,507,020 A * 3/1985 Zeitler ..... E21D 21/0086 405/302.1
4,607,984 A 8/1986 Cassidy
4,618,291 A * 10/1986 Wright ..... B25B 13/065 405/259.2
4,630,974 A * 12/1986 Sherman ..... E21D 11/006 405/259.1
4,666,344 A * 5/1987 Seegmiller ..... E21D 11/006 405/302.3
4,699,547 A * 10/1987 Seegmiller ..... E21D 11/006 405/259.1
4,708,559 A * 11/1987 Locotos ..... F16B 43/00 405/259.1
4,775,266 A * 10/1988 Seegmiller ..... E21D 11/006 405/259.1
4,917,543 A * 4/1990 Cole ..... E02D 5/04 256/73
4,984,937 A 1/1991 Karpollus
5,018,907 A * 5/1991 Chugh ..... E21D 11/006 405/259.3
5,026,217 A * 6/1991 Seegmiller ..... E21D 11/006 405/288
5,064,311 A * 11/1991 Giroux ..... E21D 21/0093 405/259.1
5,114,278 A 1/1992 Locotos et al.
5,176,473 A * 1/1993 Seegmiller ..... E21D 11/006 405/259.5
5,259,703 A 11/1993 Gillespie
5,292,209 A * 3/1994 Calandra, Jr. ..... E21D 11/006 405/259.1
5,314,268 A * 5/1994 Calandra, Jr. ..... E21D 21/0006 405/259.5
5,375,946 A * 12/1994 Locotos ..... E21D 21/0046 405/259.1
5,415,498 A * 5/1995 Seegmiller ..... E21D 11/006 405/288
5,462,391 A * 10/1995 Castle ..... E21D 11/006 405/259.1
5,525,013 A * 6/1996 Seegmiller ..... E21D 11/006 405/259.3
5,584,608 A * 12/1996 Gillespie ..... E21D 11/006 405/259.6
5,836,720 A * 11/1998 Stankus ..... E21D 11/006 405/302.2
5,913,641 A * 6/1999 Long ..... E21D 11/006 405/302.2
5,957,627 A * 9/1999 Stankus ..... E21D 11/006 405/259.1
6,146,056 A * 11/2000 Calandra, Jr. ..... E21D 21/0086 405/288
6,273,646 B1 * 8/2001 Shaw ..... E21D 21/006 405/259.1
6,921,232 B2 * 7/2005 Domanski ..... E21D 11/006 405/288
7,963,725 B2 6/2011 Dawe
8,434,970 B2 5/2013 Gaudry et al.
8,556,542 B2 10/2013 Horsch et al.
8,801,337 B2 * 8/2014 Slatter ..... E21D 21/0086 405/259.5
8,876,436 B2 11/2014 Steyn
8,926,230 B2 * 1/2015 Tadolini ..... E21D 21/008 405/302.1
9,470,088 B2 10/2016 Ahola
10,370,968 B2 8/2019 Rataj et al.
10,370,969 B2 8/2019 Gustafsson
2001/0038779 A1 * 11/2001 Lausch ..... F16B 35/00 411/250
2009/0003940 A1 * 1/2009 Oldsen ..... E02D 5/80 405/288
2009/0180841 A1 * 7/2009 Walker ..... E21D 21/008 405/302.1
2011/0311319 A1 * 12/2011 Spearing ..... E21D 21/008 405/302.2
2012/0251245 A1 * 10/2012 Spearing ..... E21D 21/008 405/302.2
2014/0147227 A1 * 5/2014 Faulkner ..... F16J 15/06 411/82
2015/0056023 A1 * 2/2015 Pinkley ..... E21D 21/0086 405/302.1
2015/0308269 A1 * 10/2015 Bryan ..... B66C 1/666 405/288
2015/0345293 A1 * 12/2015 Oler ..... E21D 11/155 405/302.1
2016/0237819 A1 * 8/2016 Faulkner ..... E21D 11/006
2018/0002885 A1 * 1/2018 Sun ..... H02S 20/10

OTHER PUBLICATIONS

Pultrall, Vrod, leaflet, www.vrod.ca, Vrod 60, Feb. 2019, US.
Pultrall, Vrod, newsletter, tunneling, www.vrod.ca, Aug. 2012, US.
Jennmar, Cuttable and Corrosion Resistant Products, catalog, pp. 49-50, unknown date, US.
Dywidag-Systems International (DSI), Threaded Fiberglass Bolts, leaflet, section 8—pp. 1-2, Aug. 2009, US.
Minova, Surface Support: roof mat, roof channel, brochure, unknown date, US.
Calibamboo, www.calibamboo.com, webpages, Yosemite composite decking, Oct. 2020, US.

* cited by examiner

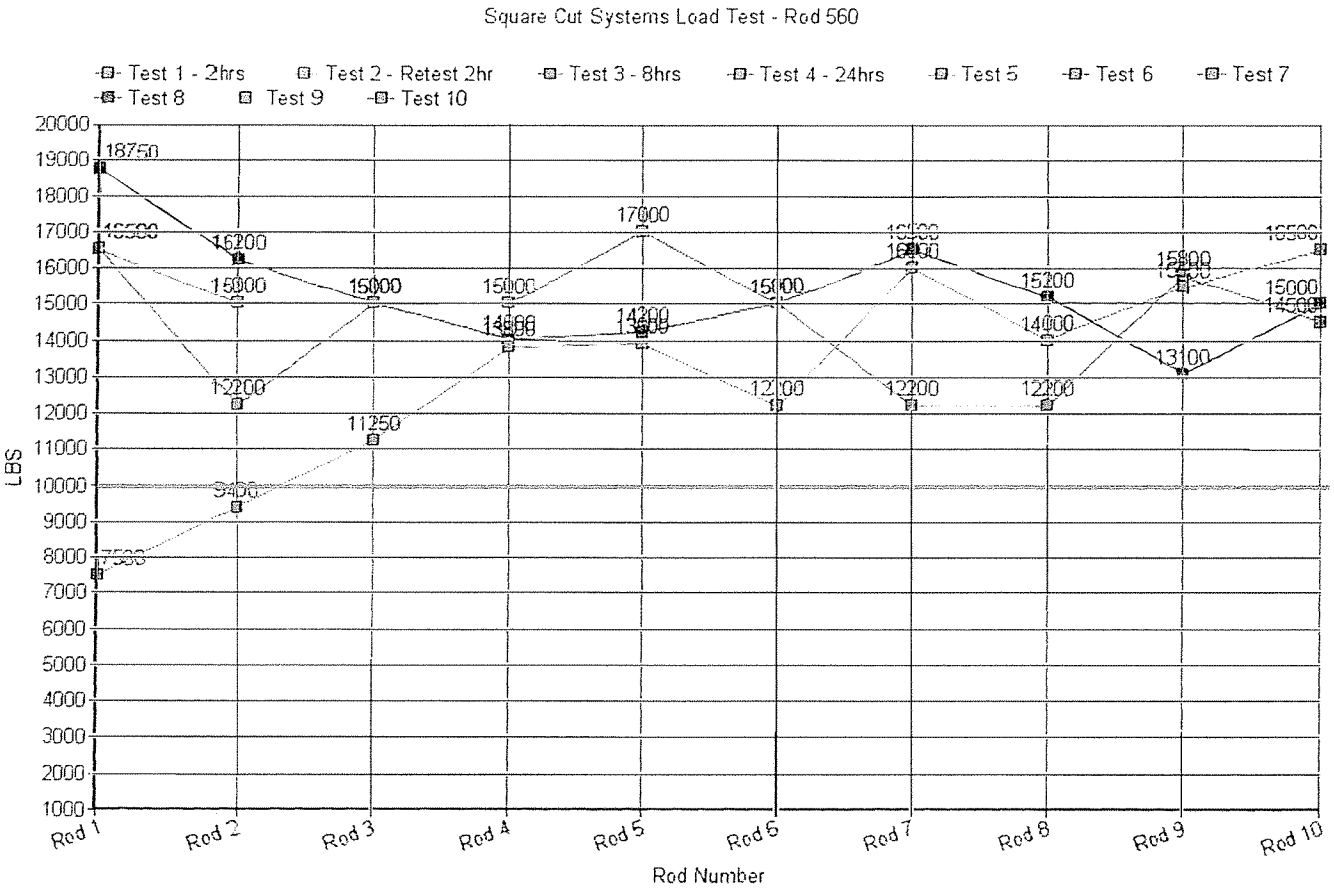

Comments:

Test 1, Rods 1&2: Product failed pull test due to slippage of the supplied fiberglass rod – to correct this, we had to further tighten down rods to reduce slippage. Doing this helped on rods 3-10.

Test 2 – Retest, Rods 1&2: These rods were retested per MSHA allowance. During test, longer bolts and washers were added to help tighten gripper onto rod. Retest parts were from a batch produced at 12:45pm and were within the 2hr timeframe for testing.

Testing has been reduced to 2hrs, 8hrs, & 24hrs per MSHA allowance. Any other testing done would be gathering additional data for both Tri-Craft Inc. and Square Cut Systems.

FIG. 9

| Square Cut Systems - Pull Testing Data (10,000lbs +) | | | | | | | | | | | | | |
|---|---|---|---|---|---|---|---|---|---|---|---|---|---|
| Test #: | Date: | Time: | Temp: | Bolt #1 | Bolt #2 | Bolt #3 | Bolt #4 | Bolt #5 | Bolt #6 | Bolt #7 | Bolt #8 | Bolt #9 | Bolt #10 |
| 1 | 7/15/2019 | 1:15pm | 77°F | 1600psi | 2000psi | 2400psi | 2900psi | 2950psi | 2600psi | 3250psi | 3000psi | 3200psi | 3500psi |
| Test #: | Date: | Time: | Temp: | Bolt #1 | Bolt #2 | Bolt #3 | Bolt #4 | Bolt #5 | Bolt #6 | Bolt #7 | Bolt #8 | Bolt #9 | Bolt #10 |
| 2 *Retest* | 7/15/2019 | 2:56pm | 77°F | 3500psi | 3000psi | | | | | | | | |
| Test #: | Date: | Time: | Temp: | Bolt #1 | Bolt #2 | Bolt #3 | Bolt #4 | Bolt #5 | Bolt #6 | Bolt #7 | Bolt #8 | Bolt #9 | Bolt #10 |
| 3 | 7/15/2019 | 7:29pm | 78°F | 3500psi | 2600psi | 3200psi | 3200psi | 3600psi | 3200psi | 2600psi | 2600psi | 3400psi | 3100psi |
| Test #: | Date: | Time: | Temp: | Bolt #1 | Bolt #2 | Bolt #3 | Bolt #4 | Bolt #5 | Bolt #6 | Bolt #7 | Bolt #8 | Bolt #9 | Bolt #10 |
| 4 | 7/16/2019 | 11:54am | 77°F | 4000psi | 3400psi | 3200psi | 3000psi | 3100psi | 3200psi | 3500psi | 3300psi | 2800psi | 3200psi |
| Test #: | Date: | Time: | Temp: | Bolt #1 | Bolt #2 | Bolt #3 | Bolt #4 | Bolt #5 | Bolt #6 | Bolt #7 | Bolt #8 | Bolt #9 | Bolt #10 |
| 5 | | | | | | | | | | | | | |
| Test #: | Date: | Time: | Temp: | Bolt #1 | Bolt #2 | Bolt #3 | Bolt #4 | Bolt #5 | Bolt #6 | Bolt #7 | Bolt #8 | Bolt #9 | Bolt #10 |
| 6 | | | | | | | | | | | | | |
| Test #: | Date: | Time: | Temp: | Bolt #1 | Bolt #2 | Bolt #3 | Bolt #4 | Bolt #5 | Bolt #6 | Bolt #7 | Bolt #8 | Bolt #9 | Bolt #10 |
| 7 | | | | | | | | | | | | | |
| Test #: | Date: | Time: | Temp: | Bolt #1 | Bolt #2 | Bolt #3 | Bolt #4 | Bolt #5 | Bolt #6 | Bolt #7 | Bolt #8 | Bolt #9 | Bolt #10 |
| 8 | | | | | | | | | | | | | |
| Test #: | Date: | Time: | Temp: | Bolt #1 | Bolt #2 | Bolt #3 | Bolt #4 | Bolt #5 | Bolt #6 | Bolt #7 | Bolt #8 | Bolt #9 | Bolt #10 |
| 9 | | | | | | | | | | | | | |
| Test #: | Date: | Time: | Temp: | Bolt #1 | Bolt #2 | Bolt #3 | Bolt #4 | Bolt #5 | Bolt #6 | Bolt #7 | Bolt #8 | Bolt #9 | Bolt #10 |
| 10 | | | | | | | | | | | | | |

FIG. 10

SYSTEM AND METHOD FOR SUPPORTING SIDEWALLS OR RIBS IN COAL MINES

CROSS-REFERENCE TO RELATED APPLICATIONS

The present application claims benefit of provisional application Ser. No. 62/898,580 filed Sep. 11, 2019, the contents of which are incorporated herein by reference.

BACKGROUND

Field of the Invention

The present invention relates to a cuttable, sinkable anchoring system and method for supporting the sidewall or ribs of a coal mine. In particular, the instant invention includes a sinkable (high specific gravity) hollow core bearing plate and cuttable fiberglass rods inserted therethrough which, in combination, gives the minimum suggested strength and can be used in other mineable ore systems that use a longwall system, for example.

Description of the Related Art

A mine rib is the side of a pillar or the wall of an entry of a mine, i.e. the solid material on the side of any underground passage. As mining progresses, the loading on coal mine ribs increases as they support the overburden load previously held up by the recently mined coal. Pillar rib failure, sometimes called a roll, can occur as the edges of the rib yield under the excessive pressure of the overburden rock weight and cracks or other natural defects cause sections to become detached and fall away.

There are a variety of rib and roof control techniques observed in coal mines. Roofs, face and ribs of areas where persons work or travel are required by regulations to be supported or otherwise controlled to protect persons from the hazards related to falls of the roof, face or ribs and coal or rock bursts. Currently, there are no minimum strength requirements for rib support. Rib and roof control techniques observed in underground coal mines include the following: (1) re-orienting the roadways with respect to the orientation of the cleat system in the seam, (2) installing intrinsic rib support systems in the form of bolts with or without meshes, (3) installing external rib support systems in the form of meshes (steel and synthetic), props, vertical fixtures anchored to the roof and/or floor, and pillar banding, etc., and (4) applying several of these methodologies simultaneously.

Rib bolts are categorized based on their anchorage mechanism into mechanical, grouted and mechanical/grouted bolts. Mechanical and mechanical/grouted anchorage rib bolts are always tensioned during installation. Intrinsic rib support systems involve bolts (non-cuttable and cuttable) installed into the ribs. Non-cuttable rib bolts are made of steel, while cuttable rib bolts are made of fiberglass or plastic.

As is known, longwall mining is a form of underground mining where a long wall of ore is mined in slices, leaving behind roofs and walls of ore faces which must then be supported. For years, it has been recognized in the mining industry where a longwall system is being used, that there is a need to: (1) support the sidewall or rib where the shear machine cuts the coal or ore; and, (2) that this support system should be cuttable so as to prevent problems of safety to personnel such as sparking, ignitions, explosions, and entanglement with the shear machine bits and further down the line on conveyor belts and in the processing plant. These systems are preferred to be cuttable (by the shear machine in a longwall method of coal mining) because steel systems get caught in the shear machine bits and can cause other problems downstream. Wood dowels, threaded fiberglass bolts, and plastic bolts have been used. However, wood is not as strong as steel or fiberglass in this application. Moreover, problems exist inasmuch as the bearing plates and cuttable components sheared from the rib float as opposed to sink causing waste within the product stream. By engineering high specific gravity (sinkable) components, the components sink in the preparation facility heavy media vessel, thereby entering the refuse stream.

There is a need then for a cuttable, fiberglass rib support system which is safer for mining personnel, less damaging to cutting heads/shearers and which is also sinkable and cost-effectively produced.

SUMMARY

Comprehended is a cuttable, sinkable mining bolt system for use in supporting the sidewall or rib in a coal mine. Provided is a rock bolt system, comprising a bearing plate, the bearing plate having a plurality of hollow cores defined transaxially therein and a central hole defined axially therethrough, the bearing plate made of modified recycled, rigid PVC compound.

A fiberglass bolt having a roughened surface is adapted to be inserted through the central hole of bearing plate. Bolt has a head component and integral rod component each consisting of glass fiber reinforced plastic. Head component includes a square head and integral, beveled washer for self-centering in the bearing plate as rod component is installed into rib.

Bearing plates are adapted to sink into a refuse stream. Hollow cores of bearing plate reduce the material and thus the weight and expense of the bearing plate while still allowing the bearing plates to sink. Optionally, rod components can be inserted transaxially through the hollow cores to increase the strength of the system and expand coverage area.

More specifically, comprehended is a mining bolt system including a bearing plate and bolt combination. In one embodiment, the bearing plate has a plurality of hollow cores defined transaxially therein, the bearing plate having a central hole defined axially therethrough, the bearing plate consisting of a rigid, polyvinyl chloride compound (PVC), wherein the PVC is formulated for high specific gravity, to thereby allow the bearing plate to be cuttable and sink in a solution to 1.6 specific gravity (SG) or greater. In another embodiment, a preferably metal version of the bearing plate includes an undulating surface, the undulating surface defined by a pair of edge surfaces which travel downward to form edges, the undulating surface further defined by a dipping medial portion relative to the edge surfaces to thereby define a pair of pockets through which rebar can be received. Then, a chuck assembly can be placed around the rebar such that the rebar and chuck assembly can be disposed within the pocket underlying the bearing plate to receive an inward compression force from the bearing plate.

For the bolt, the bolt includes a rod portion and a bolt head, the rod portion having a rod surface, the bolt head including a first annular and a second annular with a beveled washer fixed between the first annular and the second annular, the beveled washer defined by a tapered surface and a flange, the bolt including a cubical knob formed on the first annular, and wherein the bolt consists of glass fiber reinforced polymer (GFRP). As such, the bolt head is overmolded to the rod portion to form the bolt entirely as a one-piece, polymer bolt, which is also cuttable.

Additionally, metal or polymer rebar or strand cable is received transaxially by the bearing plate, wherein the rebar or strand cable is adapted to connect more than one of the bearing plates across the side wall to thereby enhance the inward force. Accordingly, a method for supporting a side wall, comprises the steps of: anchoring multiple bearing plates into the side wall axially, further comprising the step of fastening a fiberglass bolt through the bearing plate into the side wall; and enhancing an inward force of the bearing plates by inserting fiberglass rebar transaxially through the bearing plates.

BRIEF DESCRIPTION OF THE DRAWINGS

FIG. 9 is a graph of a load test.

FIG. 10 is a table of pull testing data.

DETAILED DESCRIPTION OF THE PREFERRED EMBODIMENT

Figure 1:
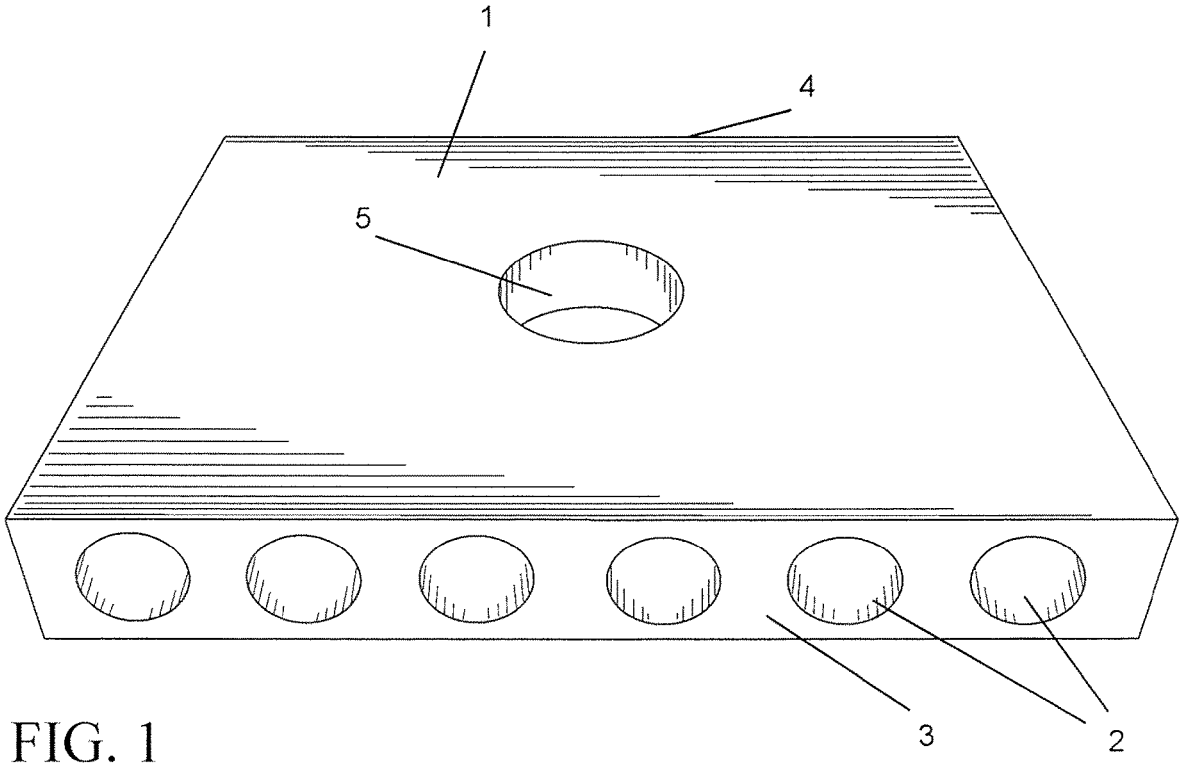
FIG. 1 shows a perspective view of the bearing plate.
Figure 2:
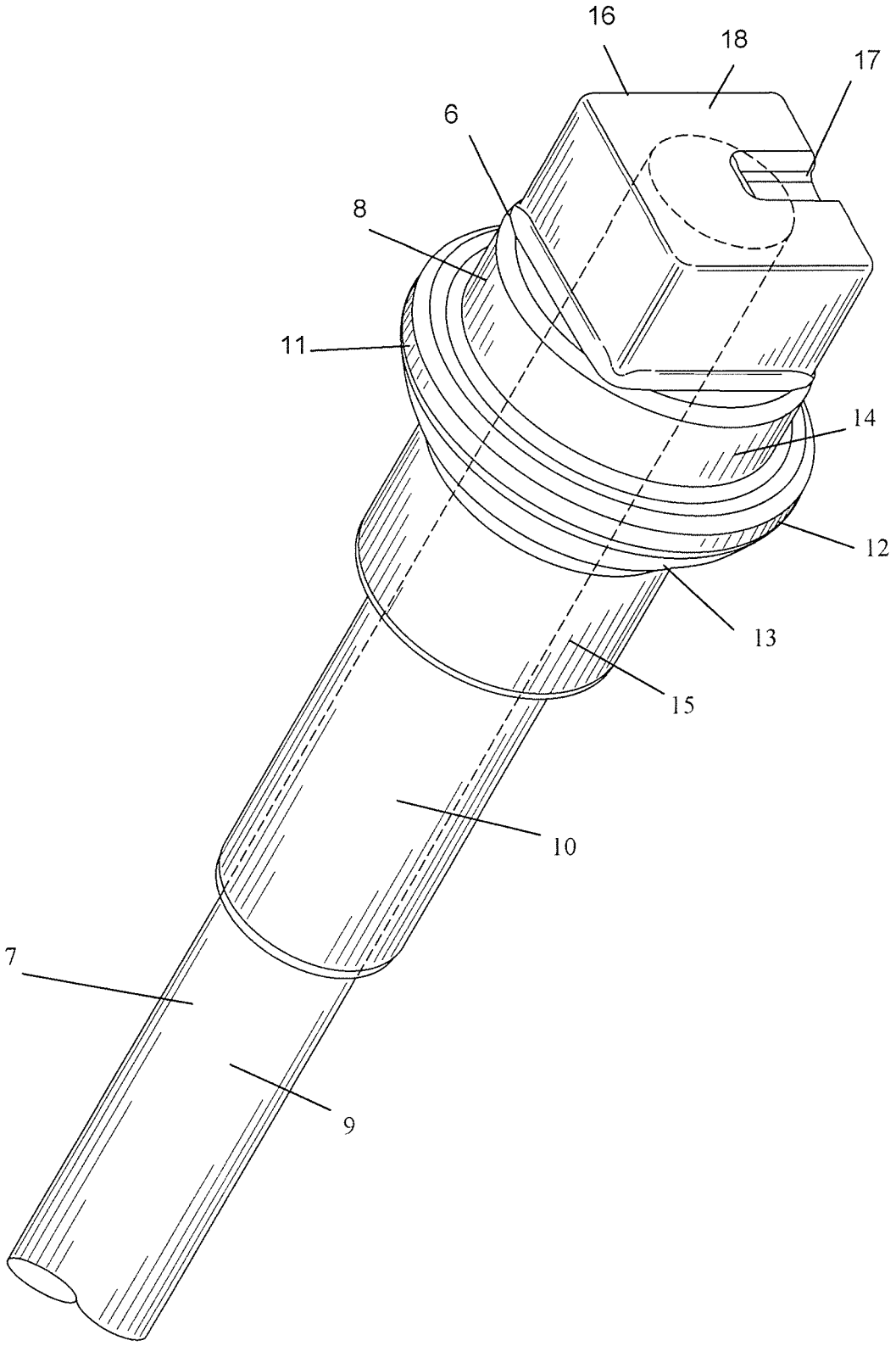
FIG. 2 shows a perspective view of the bolt, which includes both head and rod portion.
Figure 3:
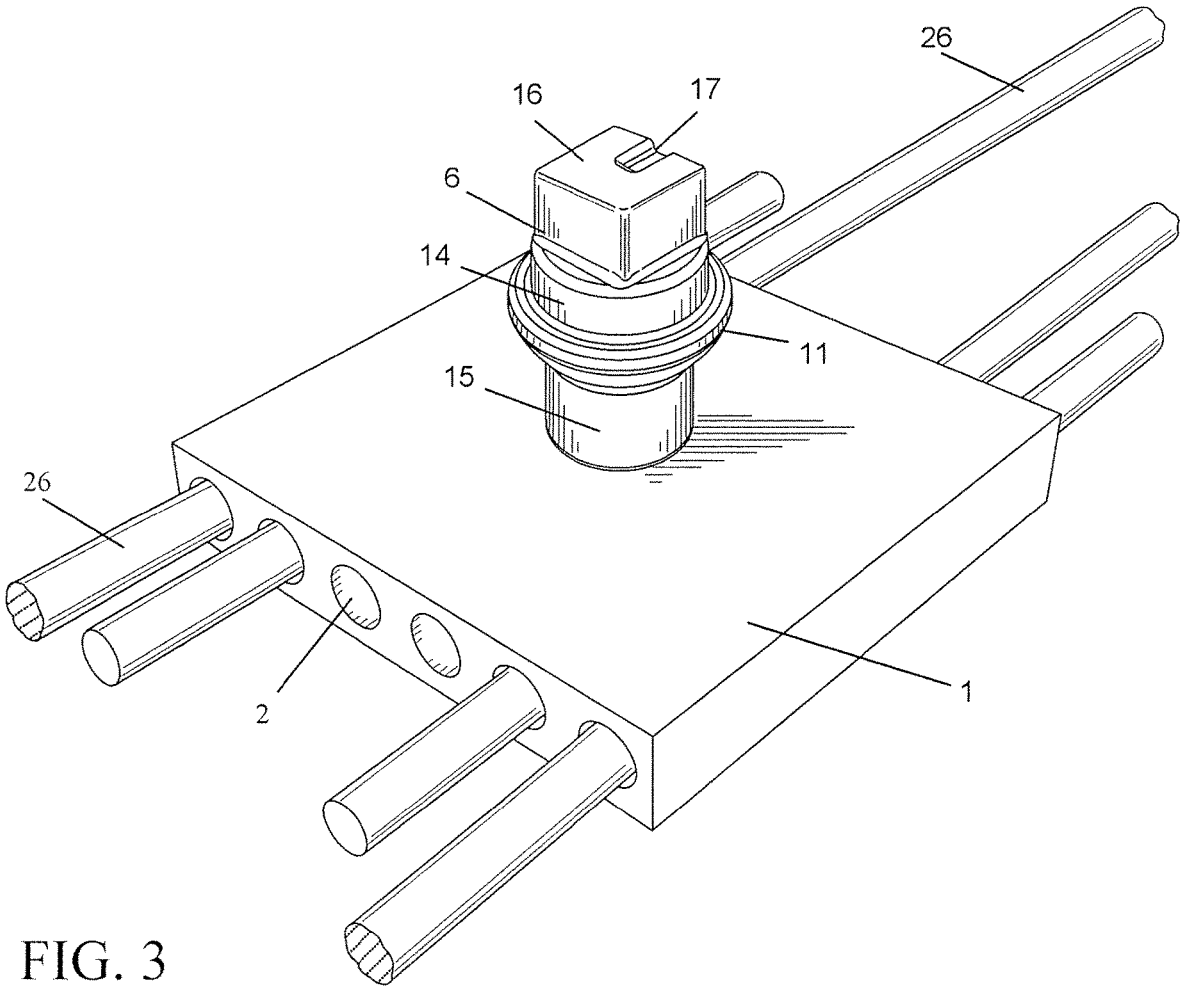
FIG. 3 shows a broken perspective view of the fiberglass bolt inserted through the central hole of bearing plate along with the rod portions of each bolt passing transaxially through the hollow cores bores of the bearing plate (both 'y' and 'x' axis penetration).
Figure 4:
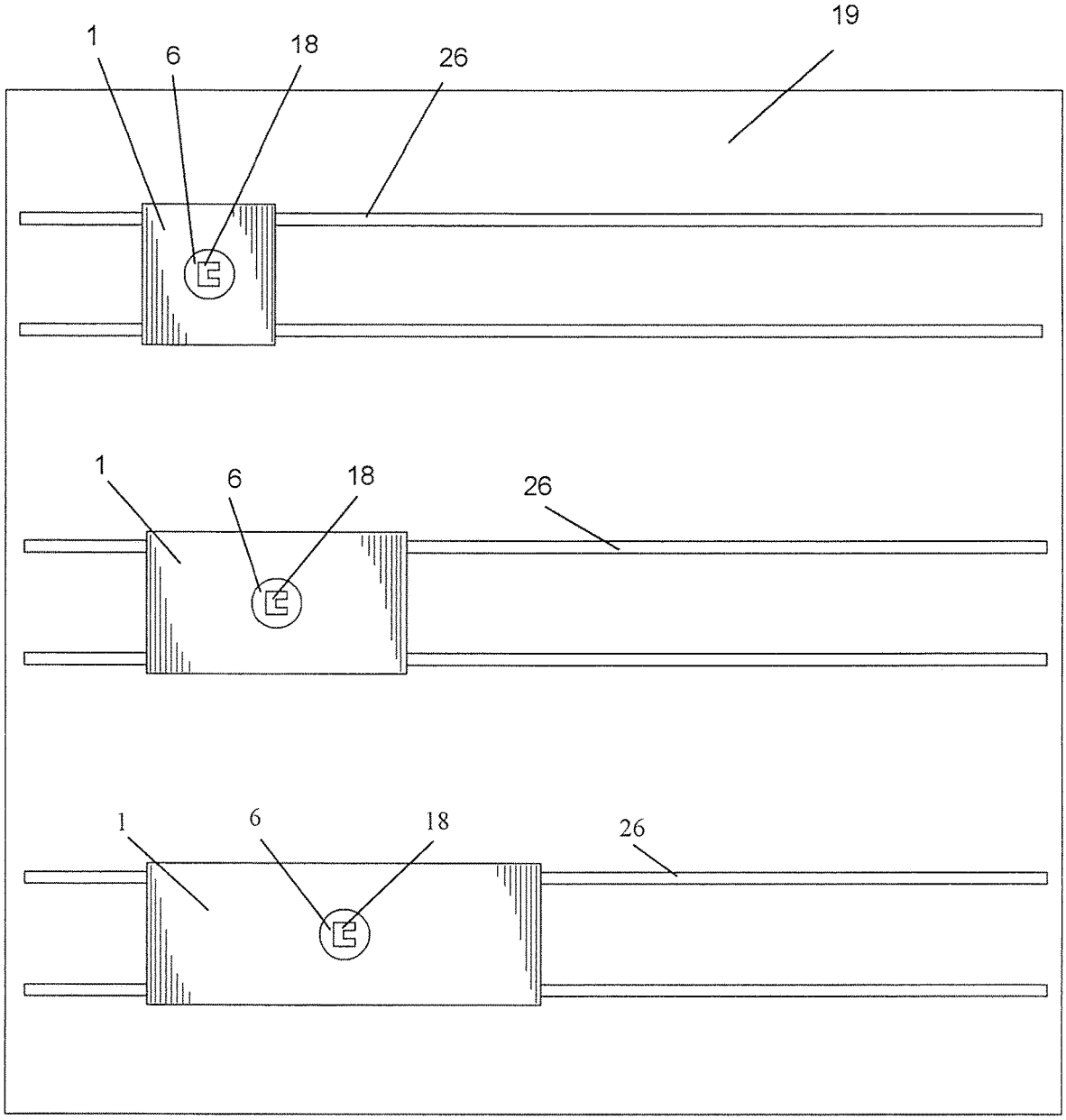
FIG. 4 shows a side view in elevation of the bolt system applied across a mine side wall side view with bearing plates of various size.
Figure 5:
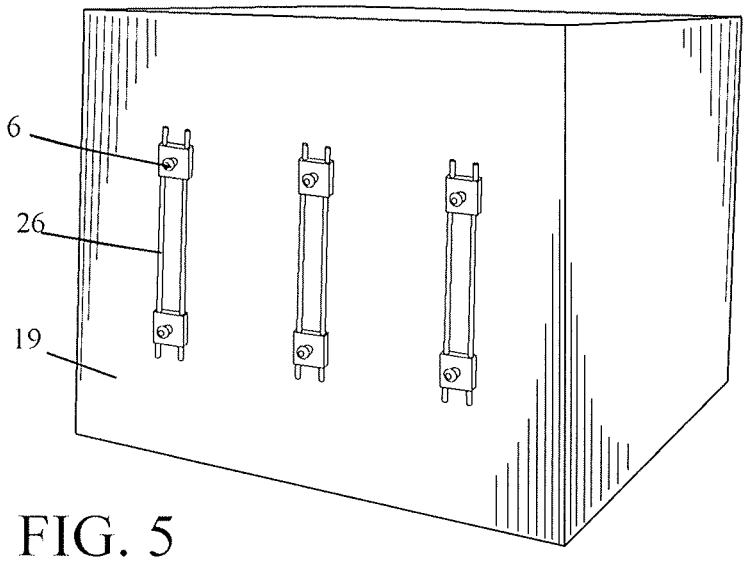
FIG. 5 shows a perspective view of the bolt system in an alternative, vertical arrangement.
Figure 6:
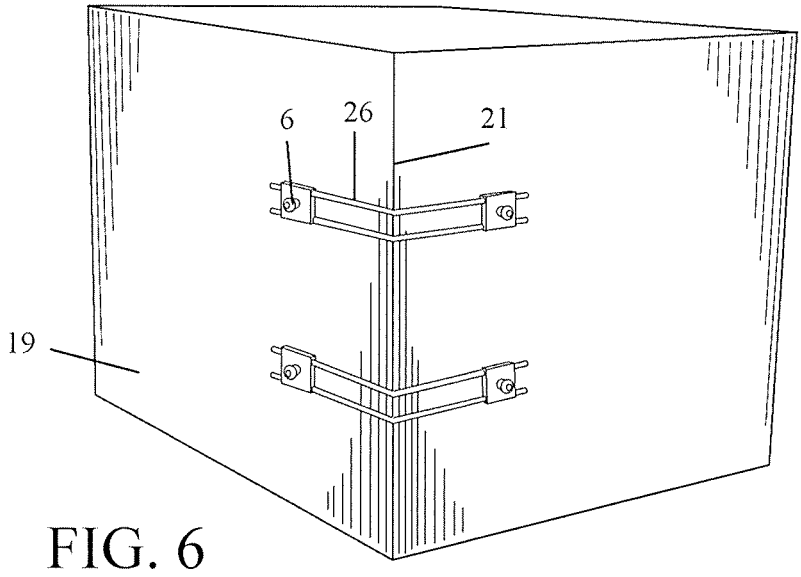
FIG. 6 shows a perspective view of the bolt system in an alternative arrangement around the corner of the side wall.
Figure 7:
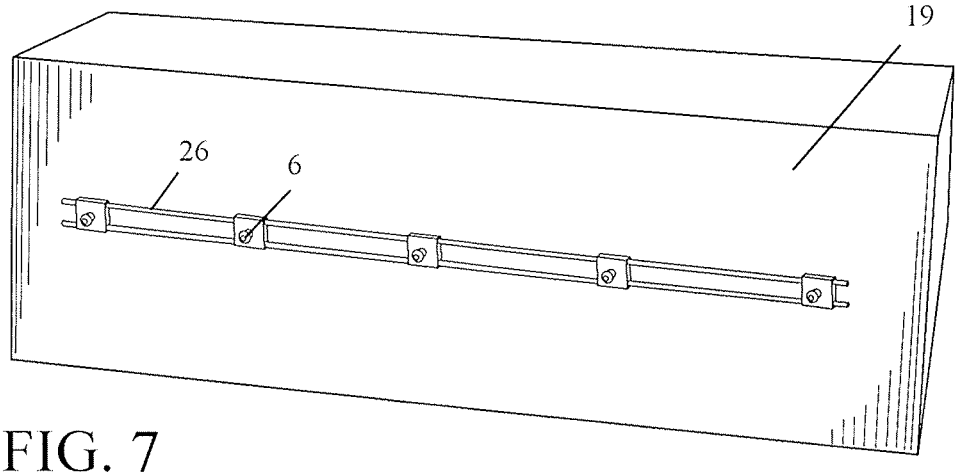
FIG. 7 shows a perspective view of the bolt system in an alternative, continuous, horizontal arrangement.

Referencing then FIGS. 1-10, shown is the instant cuttable mining bolt system, or rock bolt system. The rock bolt 6 is for use in supporting the sidewall or rib in a coal mine for example. As used herein, "side wall 19" means a wall, roof or any supporting rib within a mine or rock formation, tunnel or within any environment which requires anchoring. "A" as used in the claims means one or more. The instant mining bolt system comprehends three main subassemblies, namely a bearing plate 1, a bolt 6 and rebar 26 (connecting rods or cable strands), as follows.

The first subassembly is a bearing plate 1. Bearing plate 1 has a top bearing surface 1*a* and a bottom bearing surface 1*b*. The top bearing surface 1*a* and bottom bearing surface (not visible are each entirely flat but for a central hole 5. Bearing plate 1 preferably consists of a modified recycled, rigid polyvinyl chloride (PVC) compound. In one embodiment, the PVC is formulated for high specific gravity if desirable (regular PVC can be used without additives). Due the formulation of the PVC, the high specific gravity still allows the bearing plate 1 to sink in solutions to 1.6 SG or greater, which might be typical for iron-containing wastewater, thus falling to the bottom of any preparation facility heavy media vessel, to thereby enter the refuse stream. In other words, whereas the SG of PVC is typically 1.4 and would sink in water, the formulation must be such that it sinks in a higher SG medium and the instant formulation accomplishes this. The formulation is available from Meridian Precision, Inc., Pine Grove, Pa. In the preferred embodiment (although not limited thereto) bearing plate 1 is square having a width of 6", depth of 6" and a height of 1", but because the bearing plates 1 are extruded, various lengths, widths and depths may be used. Defined transaxially (along 'x' axis) through the bearing plate 1 are a plurality of hollow cores 2, i.e. defined entirely from front edge 3 to back edge 4. The hollow cores 2 preferably each measure ⅝" in diameter and are uniformly spaced, 1" apart from each center (0.375 inch gap), and in this example, six (6) hollow cores 2 are shown. The hollow cores 2 reduce the weight of the bearing plate 1 and thus increases ease of use and decreases expense while the strength and specific gravity of the system is still maintained. Additionally, as further described below, the hollow cores 2 can receive rebar 26 or connecting rods such as rod portions 7 of the fiberglass bolt 6 itself. The central hole 5 is defined entirely through bearing plate 1 with center through 'y' axis, thus axially defined through the center of bearing plate 1 as shown. "Axially" also means inward towards the side wall 19, or along 'y' axis. Thus, central hole 5 is adapted to receive fiberglass bolt 6 axially therethrough, as follows.

The second subassembly comprises the bolt 6. A preferably fiberglass bolt 6 is provided which is adapted to insert through the bearing plate 1 by way of central hole 5, thus driving into side wall 19 while bearing plate 1 forcefully abuts the same to thereby anchor the side wall 19 at the location of entry. Bolt 6 has a rod portion 7 and integral bolt head 8. In the exemplar embodiment the rod portion 7 can range from 48" to 60" in length and would be saleable in these two lengths but any length can be used. The diameter of each rod portion 7 would preferably range from 0.603 to 0.703, but again, these measurements may vary as to both desired characteristics and tolerances. In the exemplar embodiment the bolt 6 is an Aslan 100 glass fiber reinforced polymer (GFRP) that combines fiberglass roving with a thermoset vinyl-ester resin system to create a long-lasting alternative to steel. The rod portion 7 has a rod surface 9 which can be modified to be roughened with granules to thereby be textured or granular to aid in grip.

Bolt head 8 is formed integral to rod portion 7, thereby forming a one-piece bolt 6. The bolt head 8 includes a first annular 14 and a second annular 15 with a beveled washer 11 fixed between the first annular 14 and the second annular 15, thus transitioning from bolt head 8 to rod portion 7 is an integral, beveled washer 11, preferably hemi-spherical, which self-centers within the bearing plate 1. Beveled washer 11 is defined by a tapered surface 13 and a flange 12. A sleeve 10 is integrally formed between the second annular 15 and the rod portion 7. A generally cubical knob 16 is formed on the first annular 14. An indentation is defined on a top surface 18 of knob 16 which acts as a physical stop to correct the depth of the over-mold manufacturing process because the bolt head 8 is injection molded around rod portion 7 to form entire bolt 6. More particularly, an over-mold process uses 50% GFRP products that are heated, molten stage, then shrunk around the rod portion 7 to achieve at least 10,000 tensile strength (see FIG. 9). This process results in the similar, sinkable characteristics of the bearing plate 1 such that both the bolt 6 and the bearing plate 1 sink (and, of note, non-conductive).

The third subassembly includes one or more rebar 26. "Rebar 26" in this embodiment means connecting rods or dowels, which may be made of any material such as traditional steel, or they can be formed of similar polymer make-up as the rod portion 7 and could, in fact, be the rod portions themselves. Additionally, they can be steel cables as further defined (i.e. cable strand). More particularly, while rod portions 7 are the long end of bolt 6 and are, in one embodiment, driven in to the side wall 19 with the bearing plate 1 providing in inward (towards the side wall 19) retaining force against the sidewall/rib, axially through each bearing plate 1, the rod portions 7 can serve the secondary function of being inserted transaxially through the hollow cores 2 of the one or more bearing plates 1. In addition, the bearing plates 1 can be resized along the length of the system if they are used merely to capture a rod portion 7. The rebar 26 is not adhered to the bearing plate 1 but rather "inserted" therein to rely on friction for securement and to absorb any load. Any number of rebar 26 and accompanying hollow cores 2 of bearing plate 1 can be used depending on the needed application, i.e. only some of the hollow cores 2 could be occupied. For instance, referencing FIGS. 3-7, shown is an embodiment wherein the rebar 26 (as defined) are inserted and thus secured through the hollow cores 2 of bearing plates 1 transaxially. Moreover, the mining bolt system, therefore, can be disposed in various configurations, e.g. vertical or horizontal, any orientation, and at various locations, e.g. around a corner 20 of the side wall 19 (see FIG. 6). "Vertically" would mean, for example, in an arrangement where the rebar 26 travels from floor to ceiling of a tunnel and "horizontal" would therefore be generally perpendicular to this arrangement. Of course, this provides for an orientation at any angle or corner as long as the hollow cores 2 nearly face opposing hollow cores 2 to form the connection prior to receiving the load (and thereafter potentially moving). In addition, any number of hollow cores 2 may be occupied (e.g. two outer, then two inner on an adjacent bearing plate 1). Therefore, "any orientation" is meant to cover such variations and numbers and is defined herein as the combination bearing plates 1 and rebars 26 ability to tension in a variety of configurations as shown and described. As such, the system upon assemblage is further tensioned by providing an additional inward force towards the side wall 19 as each bolt 6 bears against the bearing plate 1 and, in combination, rebar 26 provides an added inward force. Accordingly, a means is provided for increasing the leveraging and thus enhancing the anchoring force of the bearing plate 1 when the bearing plates 1 are coupled with additional rebar 26 and/or all subassemblies are used in combination.

Figure 8:
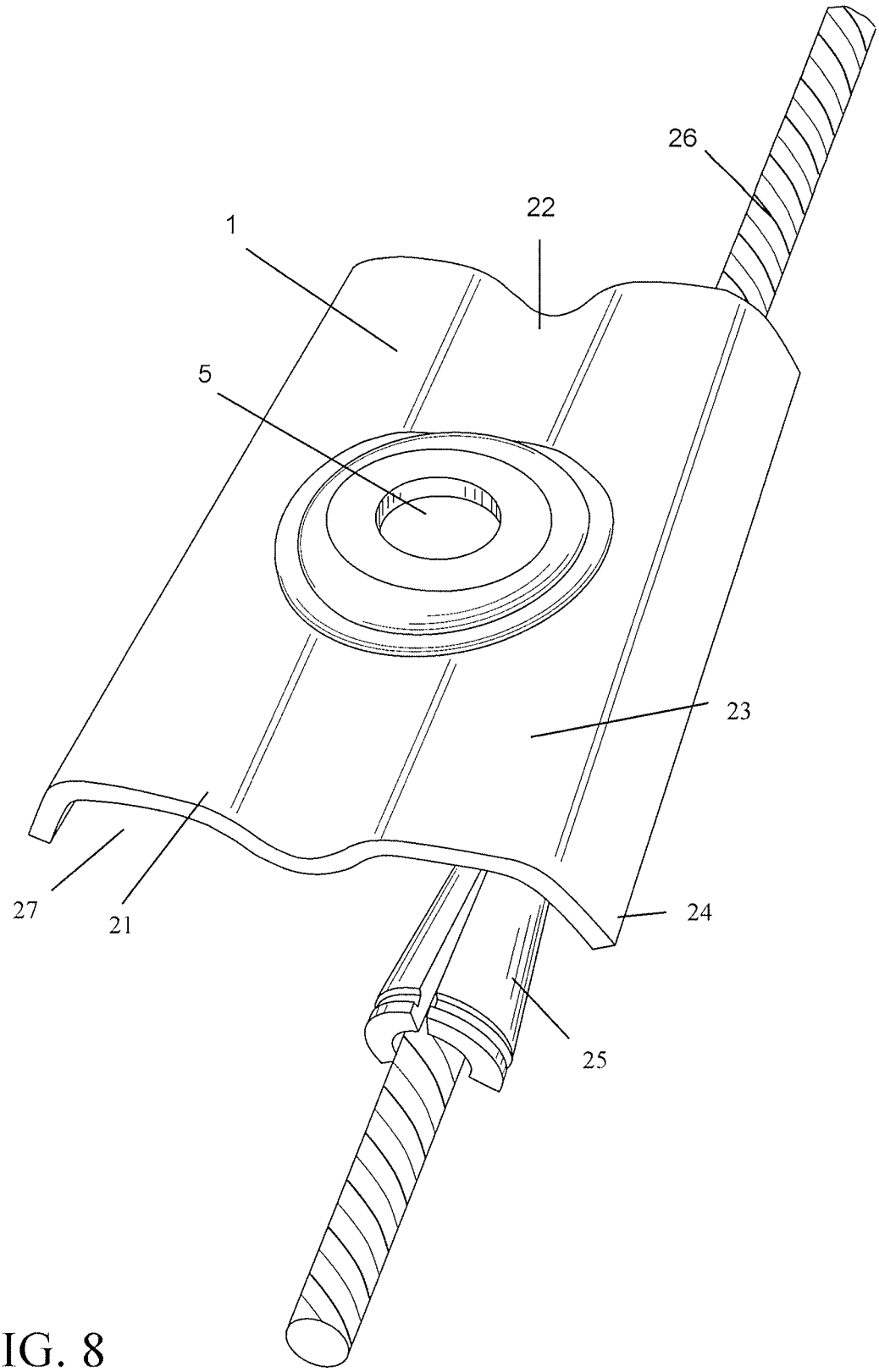
FIG. 8 shows a perspective view of an alternative embodiment.

With specific reference now to FIG. 8, shown is an alternative embodiment of the bearing plate 1 and rebar 26 combination wherein the rebar 26 underlies the bearing plate 1. The rebar 26 here takes the form of a steel cable and although the rebar 26 is still "received transaxially" by the bearing plate 1, it is received by defined pockets 27. More specifically, the bearing plate 1 excludes the hollow cores 2 and instead includes an undulating surface 21, the undulating surface 21 defined by a pair of edge surfaces 23 which travel downward (relative to an edge surface 23 of bearing plate 1) to form edges 24, the undulating surface 21 further defined by a dipping (also downward) medial portion 22 relative to the same edge surfaces 23 to thereby define a pair of pockets 27 underlying the bearing plate 1. A strand chuck assembly 25 (may comprise two, three or more "wedges") can be placed around the rebar 26, here a cable, such that the cable and strand chuck assembly 25 can be disposed within the pocket underlying the bearing plate 1 to receive an inward (towards the side wall 19) compression force from the bearing plate 1 when a similar bolt 6 (not shown in this figure) is anchored.

In use therefore, and in a method for supporting a side wall 19, multiple bearing plates 1 are anchored into the side wall 19 axially, further comprising the step of fastening a fiberglass bolt 1 through the bearing plate 1 into the side wall 19; and the an inward force (toward the side wall 19) of the bearing plates 1 are enhanced by inserting fiberglass rebar 26 transaxially through the bearing plates 1, and with such combinations arranged across the side wall 19 in any orientation.

EXAMPLE 1

Testing to determine the tensile strength of the fiberglass bolt prototype was conducted. The fiberglass bolt head was used to mimic the loading conditions that would be applied to the system in an underground application. Test results are shown in FIGS. 9 and 10 and are in accordance with ASTM F432-I3 Section 10.4 for Bearing and Header Plates.

We claim:

1. A mining bolt system, comprising:

a bearing plate, said bearing plate having a top bearing surface and a bottom bearing surface, each said top bearing surface and said bottom bearing surface entirely flat but for a central hole defined axially therethrough, said bearing plate further having six hollow cores defined transaxially therein; and, a bolt, said bolt including a rod portion and a bolt head, said rod portion having a surface, said bolt head including a first annular and a second annular with a beveled washer fixed between said first annular and said second annular, said beveled washer defined by a tapered surface and a flange, said bolt including a knob formed on said first annular.

2. The mining bolt system of claim 1, wherein said hollow cores are uniformly spaced.

3. The mining bolt system of claim 1, wherein said bolt consists of glass fiber reinforced polymer (GFRP).

4. The mining bolt system of claim 3, wherein said bolt head is over-molded to said rod portion to form said bolt entirely as a one-piece bolt.

5. The mining bolt system of claim 3, wherein said rod surface is granular.

6. The mining bolt system of claim 3, wherein said knob has an indentation defined on a knob top therefor.

7. The mining bolt system of claim 1, wherein said bearing plate is a rigid, polyvinyl chloride compound (PVC).

8. The mining bolt system of claim 1, including a sleeve integrally formed between said second annular and said rod portion.

9. The mining bolt system of claim 1, further comprising a strand chuck assembly for placement around a cable strand such that said cable strand and strand chuck assembly can be disposed underlying said bearing plate to receive an inward compression force from said bearing plate.

10. A mining bolt system, comprising:

one or more bearing plates, each said bearing plate having a central bore defined transaxially therethrough, said bearing plate adapted to abut a side wall of a mine;

a bolt, said bolt including a rod portion and a bolt head, said rod portion having a surface, said bolt head integrally formed to said rod portion, said bolt including an integral, beveled washer transitioning from said bolt head to said rod portion, said bolt received through said central bore with said beveled washer self-centering within said bearing plate, thereby securing said bearing plate to said side wall to provide an inward force against said sidewall;

a rebar received transaxially by said bearing plate, wherein said rebar is adapted to connect more than one of said bearing plates across said side wall to thereby enhance said inward force;

wherein each said bearing plate includes an undulating surface, said undulating surface defined by a pair of edge surfaces which travel downward to form edges, said undulating surface further defined by a dipping medial portion relative to said edge surfaces to thereby define a pair of pockets through which said rebar is received; and, a strand chuck assembly for placement around said rebar such that said rebar and said strand chuck assembly can be disposed within said pocket underlying said bearing plate to receive an inward compression force from said bearing plate.

* * * * *